US008919912B2

(12) United States Patent
Uchida

(10) Patent No.: US 8,919,912 B2
(45) Date of Patent: Dec. 30, 2014

(54) PRINTING APPARATUS, CONTROL APPARATUS, AND CONTROL METHOD

(71) Applicant: Canon Kabushiki Kaisha, Tokyo (JP)

(72) Inventor: Naoki Uchida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/860,833

(22) Filed: Apr. 11, 2013

(65) Prior Publication Data

US 2013/0286079 A1 Oct. 31, 2013

(30) Foreign Application Priority Data

Apr. 26, 2012 (JP) ..... 2012-101675

(51) Int. Cl.

| | |
|---|---|
| ***B41J 29/393*** | (2006.01) |
| ***B41J 2/01*** | (2006.01) |
| ***B41J 11/42*** | (2006.01) |
| ***B41J 13/03*** | (2006.01) |
| ***B41J 29/38*** | (2006.01) |

(52) U.S. Cl.

CPC ..... *B41J 29/393* (2013.01); *B41J 11/42* (2013.01); *B41J 13/03* (2013.01); *B41J 29/38* (2013.01)

USPC ..... 347/19; 347/101; 347/104; 347/105

(58) Field of Classification Search

CPC ..... B41J 11/42; B41J 11/36; B41J 11/44

USPC ..... 347/19, 101, 104–105

See application file for complete search history.

(56) References Cited

U.S. PATENT DOCUMENTS

| | | | | |
|---|---|---|---|---|
| 7,354,129 | B2 | 4/2008 | Uchida | |
| 2009/0237437 | A1 | 9/2009 | Uchida | |
| 2011/0199415 | A1* | 8/2011 | Taniguchi | 347/16 |
| 2013/0050324 | A1 | 2/2013 | Uchida | |

FOREIGN PATENT DOCUMENTS

| | | | |
|---|---|---|---|
| JP | 2006-272957 | A | 10/2006 |

* cited by examiner

*Primary Examiner* — Jason Uhlenhake

(74) *Attorney, Agent, or Firm* — Fitzpatrick, Cella, Harper & Scinto

(57) ABSTRACT

The present invention provides a printing apparatus comprising a storage unit storing first information about a conveyance fluctuation amount of sheet conveyance by a roller that depends on a rotational phase of the roller, and second information about a conveyance deviation amount of sheet conveyance by the roller that is independent of the rotational phase of the roller. The first and second information are used for controlling the rotation of the roller when printing an image. The second information is determined based on an actual conveyance fluctuation amount acquired by reading test patterns printed by the printing apparatus. The first information is stored previously in the storage unit.

10 Claims, 10 Drawing Sheets

3
20
11
70 REFERENCE PATTERNS ARE PRINTED BY DOWNSTREAM NOZZLES 3
20
20
20
21
11
70
REFERENCE PATTERNS ARE PRINTED BY DOWNSTREAM NOZZLES + ADJUSTMENT PATTERNS ARE PRINTED BY UPSTREAM NOZZLES 3
11
70
PRINTING CONTINUES BEFORE CONVEYANCE ROLLER

PRINTING APPARATUS, CONTROL APPARATUS, AND CONTROL METHOD

BACKGROUND OF THE INVENTION

1. Field of the Invention

The present invention relates to a conveyance control technique.

2. Description of the Related Art

In a printing apparatus typified by an inkjet printer, when the conveyance amount of a printing medium such as paper fluctuates, this affects the quality of a printed image. It is therefore proposed to correct the control amount so that the actual conveyance amount coincides with a target conveyance amount. For example, a test print of an image accompanied by conveyance of a printing medium is performed, and the correction amount is determined based on the result of reading the image (for example, Japanese Patent Laid-Open No. 2006-272957).

The method of performing a test print and determining a correction amount consumes consumables such as paper and ink for the test print. It is preferable to minimize the consumption of consumables.

SUMMARY OF THE INVENTION

The present invention provides a technique of suppressing the consumption of consumables when determining a correction amount for the conveyance amount.

According to one aspect of the present invention, there is provided a printing apparatus comprising: a printing unit configured to print an image on a printing medium; a conveyance unit configured to convey the printing medium by a roller; a control unit configured to control a rotation of the roller for conveying the printing medium when printing the image with the printing unit; and a storage unit configured to store first information about a conveyance fluctuation amount of sheet conveyance by the roller that depends on a rotational phase of the roller, and second information about a conveyance deviation amount of sheet conveyance by the roller that is independent of the rotational phase of the roller, the first and second information being used for controlling the rotation of the roller when printing the image, wherein the second information is determined based on an actual conveyance fluctuation amount acquired by reading test patterns printed by the printing unit, and the first information is stored previously in the storage unit.

Further features of the present invention will become apparent from the following description of exemplary embodiments (with reference to the attached drawings).

DESCRIPTION OF THE EMBODIMENTS

The embodiment of the present invention will be described below with reference to the accompanying drawings. In this specification, the term "printing" (to be also referred to as "print") not only includes the formation of significant information such as characters and graphics, but also broadly includes the formation of images, figures, patterns, and the like on a printing medium, or the processing of the medium, regardless of whether they are significant or insignificant and whether they are so visualized as to be visually perceivable by humans.

Also, the term "printing medium" not only includes paper used in common printing apparatuses, but also broadly includes materials, such as cloth, a plastic film, a metal plate, glass, ceramics, wood, and leather, capable of accepting ink.

Furthermore, the term "ink" (to be also referred to as a "liquid") should be given a broad interpretation similarly to the definition of "printing (print)" described above. That is, "ink" includes a liquid which, when applied onto a printing medium, can form images, figures, patterns, and the like, can process the printing medium, and can process ink. The process of ink includes, for example, solidifying or insolubilizing a coloring agent contained in ink applied to the printing medium.

Further, the term "printing element" generically means an ink orifice or a fluid channel communicating with it, and an element which generates energy used to discharge ink, unless otherwise specified.

<General Outline of Printing Apparatus>

Figure 1A:
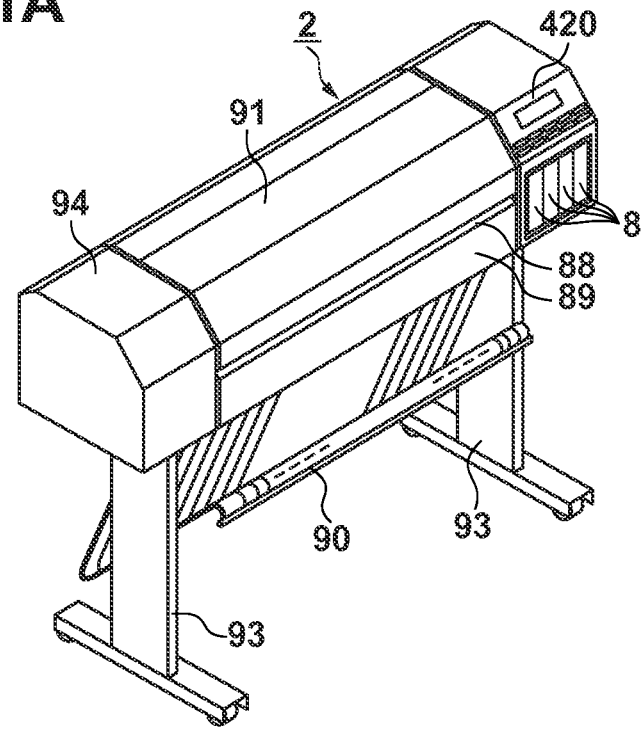
FIG. 1A is a perspective view showing the outer appearance of a printing apparatus according to an embodiment of the present invention.
Figure 1B:
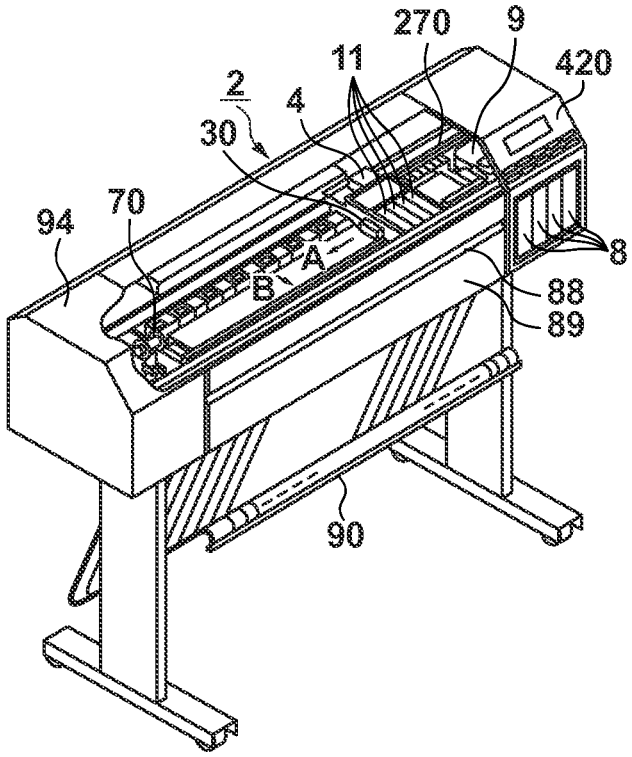
FIG. 1B is a partially cutaway view showing the printing apparatus in FIG. 1A.

FIG. 1A is a perspective view showing the outer appearance of a printing apparatus 2 according to the embodiment of the present invention. FIG. 1B is a perspective view showing the printing apparatus 2 when the upper cover is removed. The printing apparatus 2 is an inkjet printer, and is assumed to be a printing apparatus using printing media of relatively large sizes such as A0 and B0 sizes. However, the present invention is applicable to a printing apparatus using printing media of relatively small sizes.

As shown in FIG. 1A, a printing apparatus 2 has a manual insertion port 88 on the front surface, and a roll paper cassette 89 which can open to the front side is arranged below the manual insertion port 88. A printing medium (sheet) such as printing paper is supplied from the manual insertion port 88 or roll paper cassette 89 into the printing apparatus 2.

The printing apparatus 2 includes an apparatus main body 94 supported by two legs 93, a stacker 90 in which a discharged printing medium is stacked, and an openable/closable see-through upper cover 91. An operation unit 420 and ink tanks 8 are disposed on the right side of the apparatus main body 94.

As shown in FIG. 1B, the printing apparatus 2 includes a conveyance roller 70 for conveying a printing medium in a direction (sub-scanning direction) indicated by an arrow B, and a carriage 4 which is guided and supported to be able to reciprocate in widthwise directions (indicated by an arrow A: main scanning direction) of the printing medium. A conveyance roller 80 forms a conveyance mechanism together with a motor and deceleration mechanism (neither is shown), and a printing medium is conveyed by rotation of the conveyance roller 80.

The carriage 4 is coupled to an endless carriage belt 270. The carriage belt 270 forms a belt driving mechanism together with a carriage motor and pulley (neither is shown), and the carriage 4 moves along with traveling of the carriage belt 270. The carriage 4 includes a plurality of printheads 11 and a sensor unit 30.

In the embodiment, the printing apparatus prints in color on a printing medium. For this purpose, the carriage 4 supports the inkjet printheads (to be referred to as printheads hereinafter) 11 formed from four heads in correspondence with four color inks. More specifically, the printheads 11 are formed from, for example, a K (blacK) head for discharging K ink, a C (Cyan) head for discharging C ink, an M (Magenta) head for discharging M ink, and a Y (Yellow) head for discharging Y ink. A suction ink recovery unit 9 cancels an ink discharge error caused by clogging of the orifice of the printhead 11 or the like.

The sensor unit 30 is a unit capable of reading an image printed on a printing medium. In the embodiment, the sensor unit 30 is a reflection optical sensor, and reads an image by detecting the density of an image (for example, a pattern) formed on a printing medium. By combining conveyance of a printing medium in the sub-scanning direction and movement of the carriage 4 in the main scanning direction, the sensor unit 30 can read an image at an arbitrary position on a printing medium. The sensor unit 30 is also used to detect the end of a printing medium and discriminate the type of printing medium.

Figure 2:
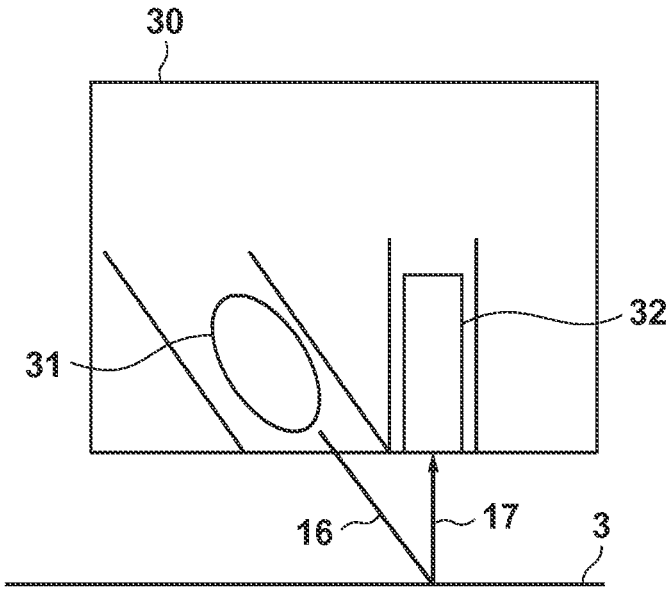
FIG. 2 is a view for explaining a sensor unit.

FIG. 2 is a view for explaining the sensor unit 30. The sensor unit 30 is a reflection optical sensor including a light emitting portion 31 and light receiving portion 32. Light 16 emitted by the light emitting portion 31 is reflected by the surface of a printing medium 3. The reflected light includes specular reflection and diffused reflection. In the example of FIG. 2, diffusely reflected light 17 is detected to more accurately detect the density of an image formed on the printing medium 3. To achieve this, the light receiving portion 32 is arranged at an angle different from the incident angle of light from the light emitting portion 31.

A white LED or three-color LED can be used as the light emitting portion 31, and a photoelectric converter having sensitivity in the visible light range can be used as the light receiving portion 32. The sensor unit 30 suffices to detect a relative density even if it cannot strictly detect the absolute value of the density of an image formed on the printing medium 3. That is, the sensor unit 30 suffices to have a detection resolution enough to detect a relative density difference in each pattern (one pattern contained in an adjustment pattern will also be called a patch hereinafter) belonging to an adjustment pattern group to be described later.

It is only necessary that the stability of the detection system including the sensor unit 30 does not influence a detected density difference till the end of detecting the entire adjustment pattern group. The sensitivity is adjusted by, for example, moving the sensor unit 30 to a non-printing portion of a printing medium. As the adjustment method, the emission intensity of the light emitting unit 31 is adjusted so that the detection level reaches an upper limit value, or the gain of an amplifier is adjusted for the light receiving unit 32. Note that sensitivity adjustment is not essential, but is preferable as a method of increasing the S/N ratio and the detection accuracy.

The spatial resolution of the sensor unit 30 is desirably a resolution large enough to detect a region smaller than the printing region of one adjustment pattern. In multi-pass printing, when an adjustment pattern group is printed so that two pattern groups are adjacent to each other in the main scanning direction and sub-scanning direction, the printing width in the sub-scanning direction decreases in accordance with the number of passes. Hence, the spatial resolution of the sensor unit 30 is set in accordance with, for example, the number of printing passes. Alternatively, the number of printing passes (printing width) to print an adjustment pattern can be determined from the spatial resolution of the sensor unit 30.

When printing an image on a printing medium with the above arrangement, the conveyance roller 70 conveys a printing medium to a predetermined printing start position. Then, the printhead 11 discharges ink while being scanned by the carriage 4 in the main scanning direction, and the conveyance roller 70 conveys the printing medium in the sub-scanning direction. By repeating these operations, the printing apparatus prints the image on the entire printing medium. After the above operations are repeated to end the printing of one printing medium, the printing medium is discharged into the stacker 90, completing the printing of one printing medium.

Figure 3:
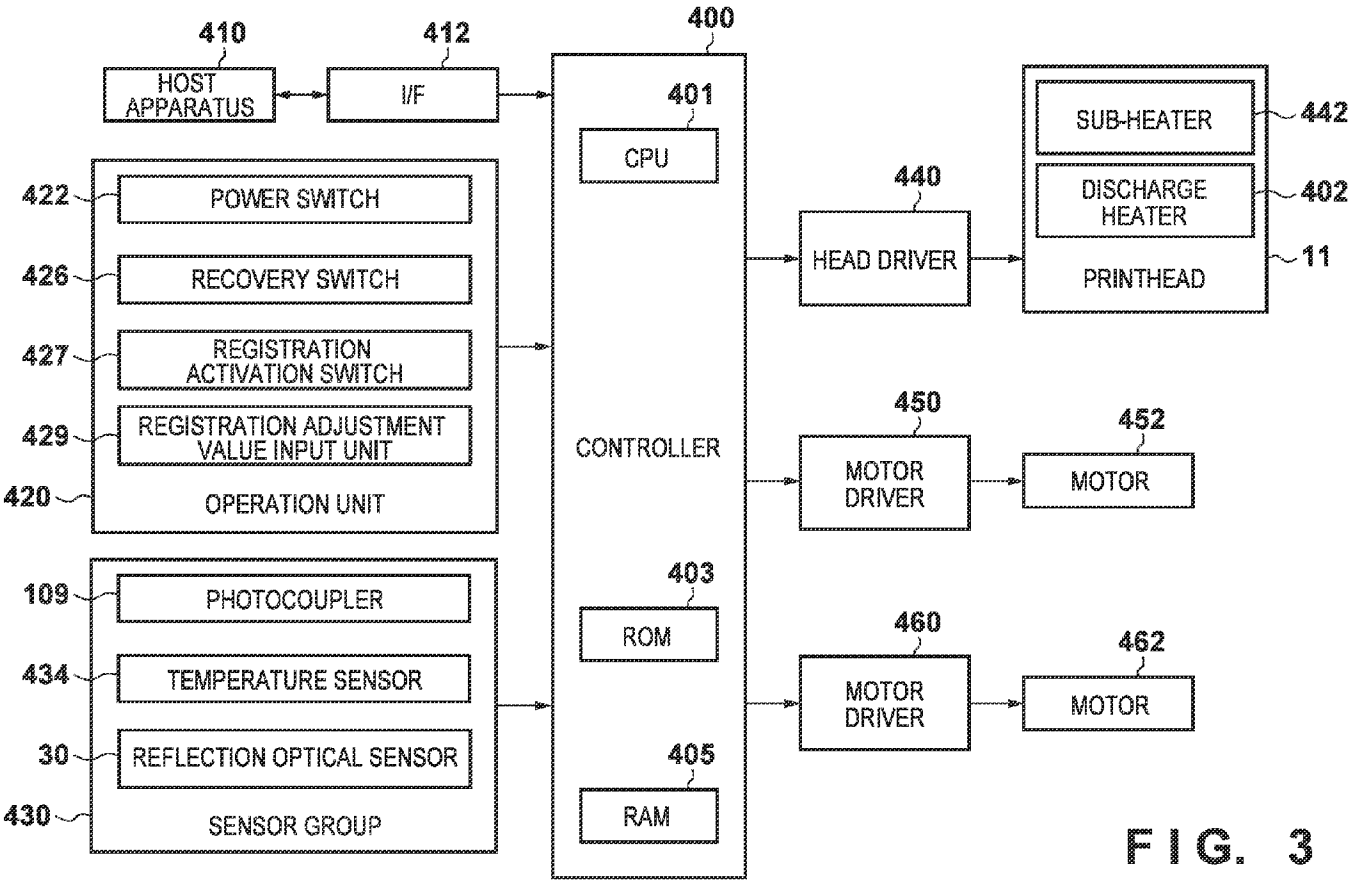
FIG. 3 is a block diagram showing the control unit of the printing apparatus in FIGS. 1A and 1B.

FIG. 3 is a block diagram showing the control unit of the printing apparatus 2. A controller 400 is a main control unit. The controller 400 includes a CPU 401, ROM 403, and RAM 405. The ROM 403 stores programs, necessary tables, and other permanent data. The RAM 405 provides an area for rasterizing image data, a work area, and the like. The ROM 403 and RAM 405 may be other types of storage devices.

A host apparatus 410 is an image data supply source. More specifically, the host apparatus 410 is a computer which performs, for example, creation and processing of data such as an image regarding printing. Alternatively, the host apparatus 410 is an image reading apparatus. Image data, other commands, status signals, and the like are transmitted and received between the host apparatus 410 and the controller 400 via an interface (I/F) 412.

An operation unit 420 includes switches for accepting instruction inputs by the operator. The switches include, for example, a power switch 422, a recovery switch 426 for instructing activation of suction recovery, a switch 427 for manually performing registration adjustment, and an input unit 429 for manually inputting an adjustment value.

A head driver 440 is a driver for driving a discharge heater 402 and sub-heater 442 in the printhead 11 in accordance with print data. A motor driver 450 is a driver for driving a main scanning (carriage) motor 452. A sub-scanning (LF) motor 462 is a motor used to convey (sub-scan) a sheet, and a motor driver 460 is a driver for the motor 462.

A sensor group 430 is a sensor group for detecting an apparatus state. The sensor group 430 includes, for example, the sensor unit 30, a photocoupler 109 for detecting that the carriage 4 stays at the home position, and a temperature sensor 434 which is arranged at an appropriate position to detect an ambient temperature. In addition, the sensor group 430 includes a sensor for detecting whether the conveyance roller 70 is positioned at the origin of rotation, and a sensor for detecting the rotational amount of the motor 462. By detecting the rotational amount of the motor 462, the rotational amount (rotational angle) of the conveyance roller 70 can be detected. The conveyance roller 70 may include a sensor for detecting its rotational amount.

<Fluctuations of Conveyance Amount>

If the printing medium conveyance amount of the conveyance roller 70 fluctuates, an ink droplet does not land on a target position, affecting the quality of a printed image. The fluctuation amount of the conveyance amount is roughly divided into a periodic component dependent on the rotational phase of the conveyance roller 70, and a constant component independent of the rotational phase of the conveyance roller 70.

The constant component typically arises from a slip between a printing medium and the conveyance roller 70. The constant component is influenced by the type of printing medium and the use environment of the printing apparatus 2.

The periodic component arises from the shape and attachment accuracy of the conveyance roller 70, and appears in one period which is one rotation of the conveyance roller 70. The periodic component will be explained in more detail.

When the perimeter of the conveyance roller 70 is 47 mm, if the conveyance roller 70 rotates one rotation to convey a printing medium, the printing medium is conveyed by 47 mm as long as there is no slip. When multi-pass printing is used to implement high-quality printing, the amount of one conveyance is smaller than the length (47 mm) corresponding to one rotation of the conveyance roller 70. For example, the sheet conveyance amount in high-quality printing is about 3.4 mm. The sheet is conveyed by about 14 times until the conveyance roller 70 rotates one rotation.

Figure 4A:
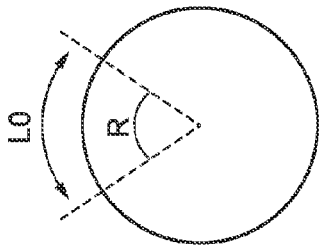
FIGS. 4A and 4B are views for explaining the difference in conveyance amount depending on the shape of a conveyance roller.
Figure 4B:
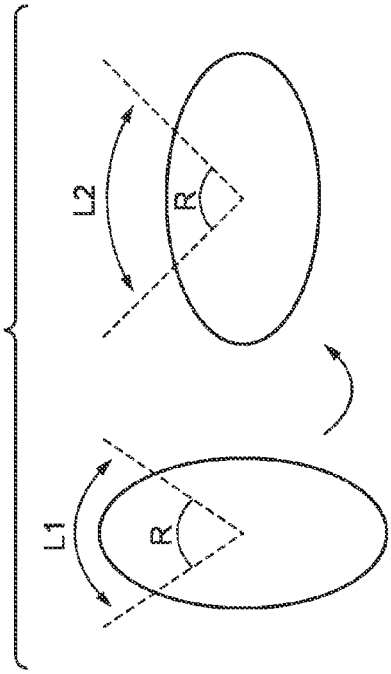

FIGS. 4A and 4B show the difference in conveyance amount depending on the shape of the conveyance roller 70. FIG. 4A shows a case in which the outer shape of the conveyance roller 70 is a perfect circle. FIG. 4B shows a case in which the outer shape of the conveyance roller 70 is not a perfect circle but another shape (an ellipse here). R is a rotational amount (rotational angle) of the conveyance roller 70 that corresponds to the amount of one conveyance. In the example of FIG. 4A, the conveyance amount is the same regardless of the rotational phase of the conveyance roller 70 (L0). However, in the example of FIG. 4B, the conveyance amount changes depending on the rotational phase of the conveyance roller 70 (L1<L2). This phenomenon occurs not only depending on the shape of the conveyance roller 70, but also when the center of rotation of the conveyance roller 70 is decentered.

<Correction of Conveyance Amount>

Figure 5:
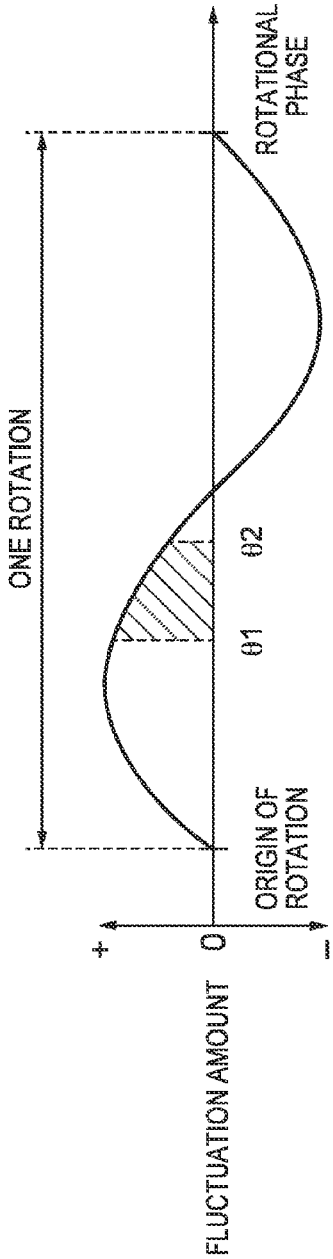
FIG. 5 is a graph exemplifying fluctuation information.

The periodic component is an apparatus-specific characteristic, and this characteristic can be measured before, for example, shipment of the product. In the embodiment, the periodic component is measured in advance and converted into data as fluctuation information. FIG. 5 exemplifies the fluctuation information.

In the example of FIG. 5, the conveyance roller 70 has a fluctuation amount corresponding to one rotation when viewed from the origin of rotation. A "+" fluctuation amount is a fluctuation amount in a direction in which the conveyance amount increases, and "−" is a fluctuation amount in a direction in which the conveyance amount decreases. A fluctuation amount when the conveyance roller 70 rotates from a rotational phase θ1 to a rotational phase θ2 is an integrated value between them (the area of a hatched portion). The fluctuation amount is 0 at the origin of rotation in the example of FIG. 5, but does not always take this value.

The fluctuation information may be, for example, a set of data at many measurement points, or an approximate expression approximated from data at measurement points. As the data format, an arbitrary format can be employed. For example, the fluctuation information (first information) may be stored in a memory (the ROM 403 or the RAM 405) and acquired by the CPU 401 from the memory, or stored in an external apparatus such as the host apparatus 410 and acquired by the CPU 401.

Figure 6:
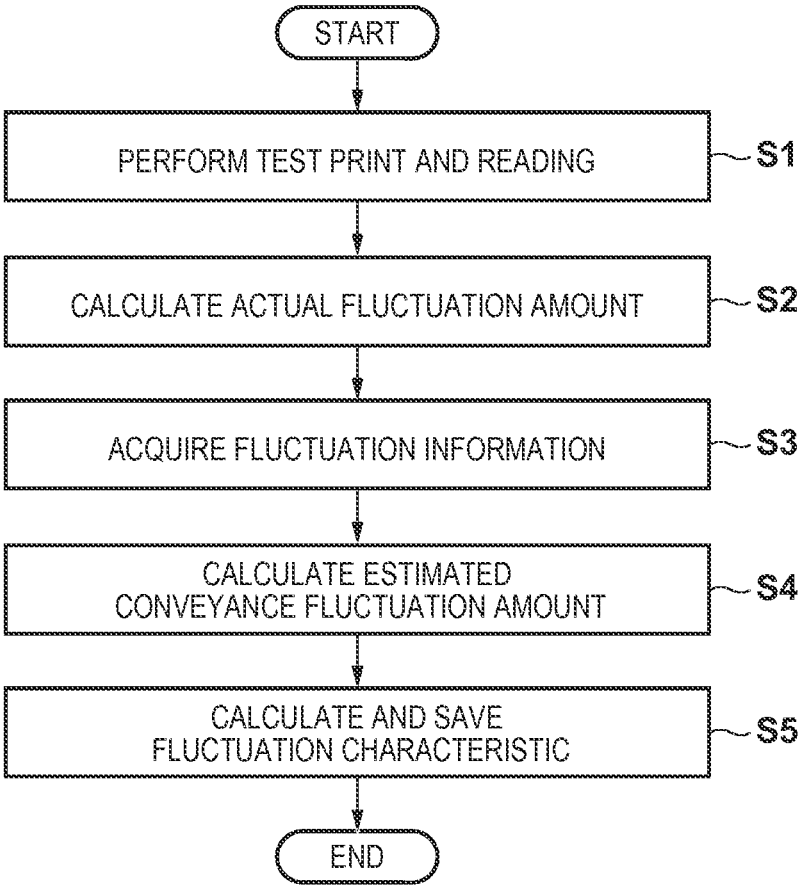
FIG. 6 is a flowchart exemplifying fluctuation characteristic derivation processing.

The constant component is influenced by the use environment of the printing apparatus 2 and cannot be measured in advance. Therefore, in the use of the printing apparatus 2, the constant component is converted into data as a fluctuation or deviation characteristic (second information). FIG. 6 is a flowchart exemplifying fluctuation characteristic derivation processing.

In the embodiment, a test print of an image (test patterns) accompanied by conveyance of a printing medium is performed (step S1). The sensor unit 30 reads the printed image, and the fluctuation amount of the conveyance amount is measured based on the reading result. Based on the result, the fluctuation characteristic is converted into data.

Figure 7:
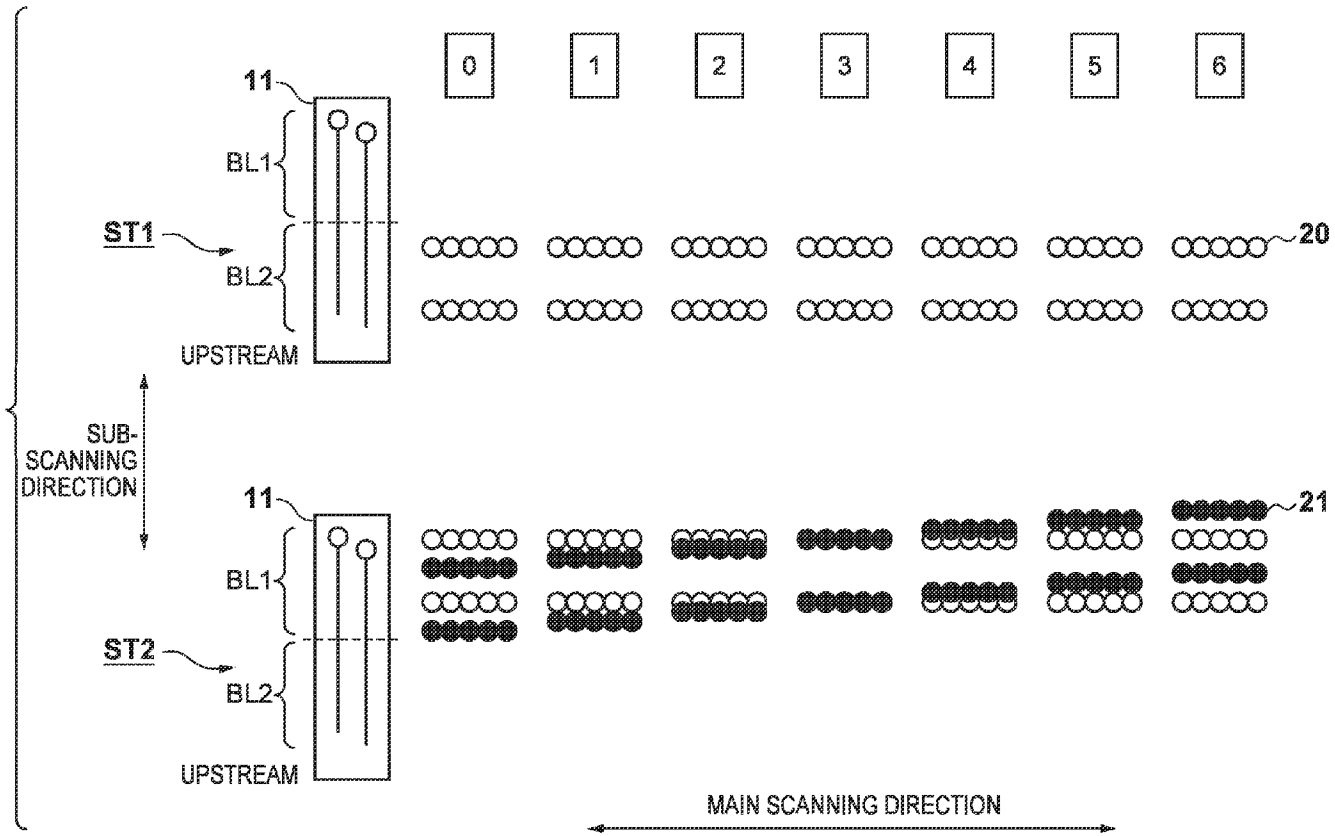
FIG. 7 is a view exemplifying a test print.

The test print can employ a known method. A detailed example will be explained. FIG. 7 is a view exemplifying the test print. Assume that the conveyance amount of one unit is half the nozzle length of the printhead 11. That is, assume that multi-pass printing of two passes is performed. Of the nozzle group of the printhead 11, a half nozzle group on the upstream side in the printing medium conveyance direction will be called a block BL2, and a half nozzle group on the downstream side will be called a block BL1.

The example of FIG. 7 shows patches printed in a given region on a printing medium. One patch region is formed from seven patches having patch numbers of 0 to 6. Although an example using seven patches will be explained, the number of patches is not limited to seven.

First, as represented by a state ST1, reference patterns 20 are printed as the first patterns by using predetermined nozzles belonging to the block BL2. Nozzles used to print the respective reference patterns 20 are the same. In the main scanning direction, seven reference patterns 20 are aligned.

Then, the printing medium is conveyed by the conveyance amount of one unit. In other words, the conveyance roller 70 rotates by a rotational amount corresponding to the conveyance amount of one unit. As described above, the conveyance amount of one unit is half the nozzle length of the printhead 11.

Next, as represented by a state ST2, adjustment patterns 21 are printed as the second patterns. For the adjustment patterns 21, different nozzles are used for the respective patch numbers of 0 to 6. For example, the adjustment patterns 21 are printed using a plurality of nozzles at a predetermined interval (for example, six nozzles).

The example of FIG. 7 assumes that when a controlled conveyance amount and actual conveyance amount are equal, the area factor of the third patch becomes smallest (the reference pattern 20 and adjustment pattern 21 most overlap each other). Hence, if the area factor of the third patch is smallest, the fluctuation amount of the conveyance amount of a printing medium can be evaluated as almost 0.

To the contrary, assume that the area factor of the second patch is smallest. In this case, the distance between a nozzle which has printed the adjustment pattern 21 of the third patch and a nozzle which has printed the adjustment pattern 21 of the second patch is the fluctuation amount of the conveyance amount. The area factor can be calculated from the result of reading a patch by the sensor unit 30. In this manner, the reference pattern 20 and adjustment pattern 21 are printed to change their overlapping form depending on the actual conveyance amount of a printing apparatus.

Figure 8:
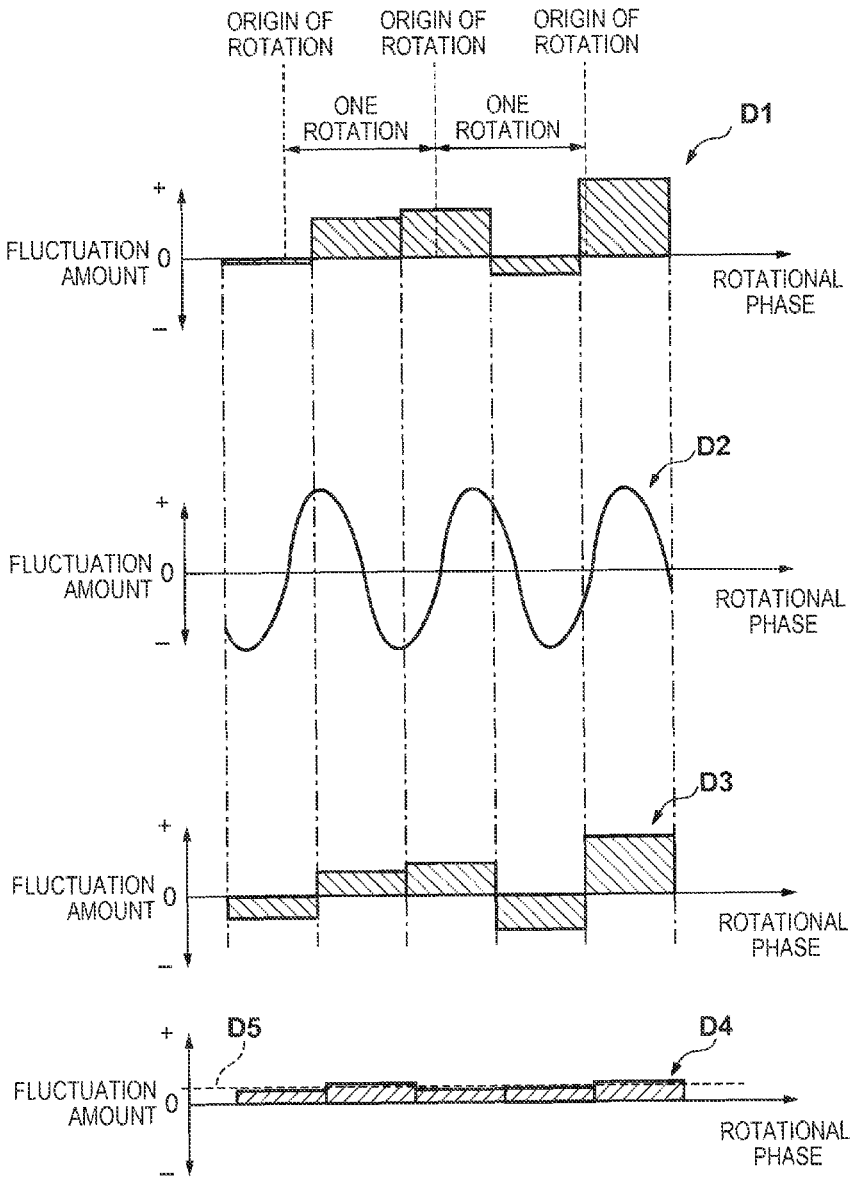
FIG. 8 is a graph for explaining a fluctuation characteristic derivation method.

Referring back to FIG. 6, the relationship between the rotational phase of the conveyance roller 70 and the actual fluctuation amount of the conveyance amount can be calculated by the test print (step S2). Data D1 in FIG. 8 exemplifies this. The example of FIG. 8 shows a case in which the printing medium is conveyed five times. During the conveyance, the conveyance roller 70 rotates a little less than three rotations.

Referring back to FIG. 6, fluctuation information is acquired from its save destination (step S3). Then, the estimated conveyance fluctuation amount is calculated (step S4), and the fluctuation characteristic is calculated and saved (step S5). The series of processes will be explained with reference to FIG. 8.

The data D1 representing an actual fluctuation amount contains both the periodic and constant components. Subtracting the periodic component from the data D1 can derive the constant component.

The periodic component can be estimated based on the fluctuation information exemplified in FIG. 5. Data D2 in FIG. 8 represents the fluctuation information, and indicates the data D1 and the rotational phase of the conveyance roller 70 together. For each conveyance, a rotational phase at the start of conveyance (printing of the reference pattern 20) and a rotational phase at the end of conveyance (printing of the adjustment pattern 21) can be obtained from the data D1. The fluctuation amount of the periodic component excluding the constant component can be estimated from information corresponding to the rotational range of each conveyance in the data D2. Data D3 exemplifies the estimated conveyance fluctuation amount of the periodic component excluding the constant component.

The difference between the data D1 and the data D3 provides data D4, which is the constant component. An average value D5 of the data D4 is the fluctuation characteristic. The average value D5 is a "+" value in the example of FIG. 8, but may be a "−" value. In this fashion, the fluctuation characteristic can be obtained. The obtained fluctuation characteristic (second information) is stored in the RAM 405 or the like in correspondence with the type of printing medium.

<Determination of Correction Amount>

A correction amount used to actually print an image can be determined by deriving a periodic component from fluctuation information and deriving a constant component from the fluctuation characteristic. By subtracting (or adding) a correction amount from (or to) the conveyance amount of one unit, the control amount is determined and a desired actual conveyance amount is obtained. The CPU 401 can determine the correction amount based on the fluctuation information and fluctuation characteristic.

<Suppression of Consumption of Consumables>

The consumable consumption suppressing effect by the fluctuation characteristic determination method will be explained. The determination method according to the embodiment can calculate a fluctuation characteristic by conveying a printing medium by only the conveyance amount of one unit at minimum and performing a test print. Hence, the consumption of consumables such as paper and ink for the test print can be suppressed. Needless to say, a more appropriate fluctuation characteristic can be obtained by performing a test print accompanied by conveyance by a plurality of units, and determining, as the fluctuation characteristic, the average value of constant components derived from the respective conveyances, as described with reference to FIG. 8.

As for the periodic component, the average value of one rotation of the conveyance roller 70 is almost 0. If the test print results of N rotations (N is a natural number of 1 or more) of the conveyance roller 70 are obtained, the average value of the fluctuation amounts of the conveyance amounts can be regarded as the constant component. However, this method increases the number N of rotations in accordance with the conveyance amount of one unit. As a result, the consumption of consumables increases. This will be explained in detail.

Figure 9A:
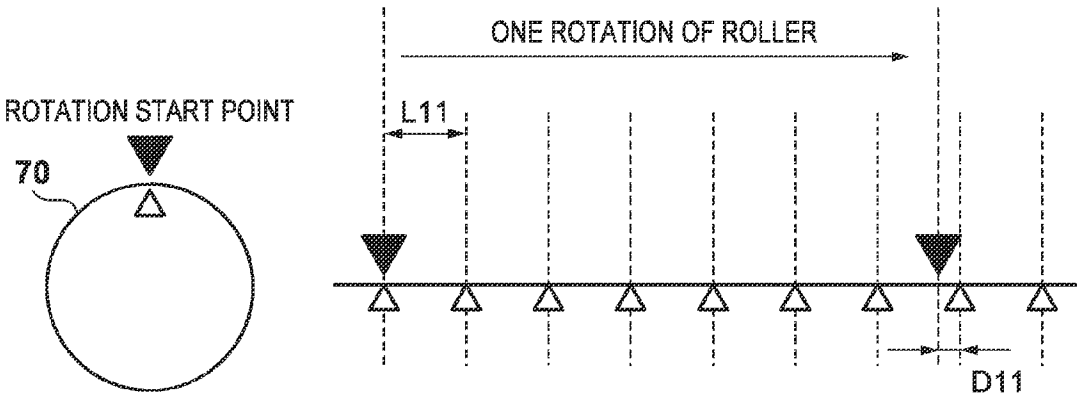
FIGS. 9A and 9B are views for explaining the deviation between the number of rotations of the conveyance roller and the conveyance amount.

FIG. 9A assumes high-pass multi-pass printing in which the number of passes is relatively large. In this case, a conveyance amount L11 of one unit is relatively small. Thus, the conveyance roller 70 rotates one rotation by a plurality of conveyances. The deviation amount of the conveyance roller 70 from the rotation start point upon one rotation of the conveyance roller 70 becomes D11. Note that the conveyance amount of one unit depends on the nozzle arrangement of the printhead 11.

Figure 9B:
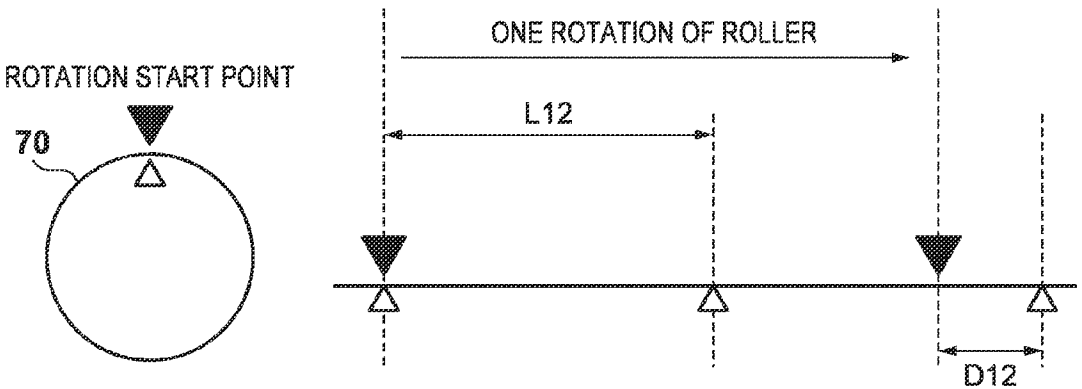

FIG. 9B assumes low-pass multi-pass printing in which the number of passes is relatively small. In this case, a conveyance amount L12 of one unit is relatively large. Thus, the conveyance roller 70 rotates one rotation by a smaller number of conveyances than that in the case of FIG. 9A. The deviation amount of the conveyance roller 70 from the rotation start point upon one rotation of the conveyance roller 70 becomes D12, which is larger than that in the case of FIG. 9A. The deviation amount tends to increase as the number of passes decreases.

If a test print is performed after rotating the conveyance roller 70 until the deviation amounts D11 and D12 become 0, the consumption of consumables increases. When the deviation amount D11 is small as in the case of FIG. 9A, it is also possible to handle the deviation amount D11 as a permissible error and derive a fluctuation characteristic by calculating the average value of conveyance fluctuation amounts. However, when the deviation amount is large, like the deviation amount D12 in FIG. 9B, it falls outside the range of a permissible error.

For example, assuming that high passes are eight passes and low passes are two passes, the deviation amount is quadrupled. When making the influence of an error in low passes equal to that in high passes, the number of rotations of the conveyance roller 70 needs to be increased, compared to high passes. The above-described fluctuation characteristic determination method according to the embodiment is especially beneficial for determining a fluctuation characteristic in low-pass multi-pass printing in which the conveyance amount of one unit is large.

The above embodiment assumes that the periodic component is measured in advance before shipment of the product and is converted into data as fluctuation information in a manufacturing factory or the like. However, the fluctuation amount may change along with aging of a conveyance roller 70, or a component regarding the conveyance mechanism may be exchanged on the market or at user's environment. In this case, the fluctuation information measured in advance cannot be used.

Considering this, a printing apparatus 2 can generate fluctuation information. For example, the printing apparatus 2 can perform in advance a test print other than the above-described test print, and derive fluctuation information from the periodic component. That is, the fluctuation amount of the conveyance amount can be obtained from the result of the other test print. The average value can be derived as the constant component. Further, the fluctuation component can be obtained by subtracting the average value from the fluctuation amount of the conveyance amount.

The other test print can be executed based on the conveyance amount of one unit in maximum passes when there are a plurality of pass counts of multi-pass printing. In this case, the deviation amounts shown in FIGS. 9A and 9B are minimized, and a more accurate constant component and fluctuation characteristic are obtained.

Figure 10A:
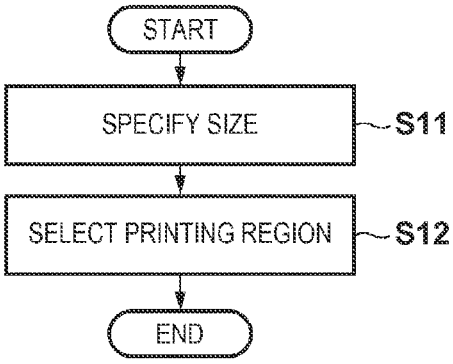
FIG. 10A is a flowchart showing selection processing.

Region selection on a printing medium to undergo a test print will be explained. In an arrangement capable of printing on a plurality of types of printing media, an optimal region to undergo a test print changes. A region on a printing medium where a test print is performed can be selected in accordance with the size of a printing medium. FIG. 10A is a flowchart showing selection processing to be executed by a CPU 401.

In step S11, the size of a printing medium is specified. The size of a printing medium can be specified based on, for example, the result of detection by a sensor unit 30. Alternatively, the size of a printing medium can be specified from size information set by the user.

In step S12, a region to undergo a test print is selected. The end region of a printing medium in the main scanning direction is affected by a meander and skewed conveyance of the printing medium. In terms of the stability of conveyance, the central region of the printing medium in the main scanning direction can be selected.

A condition in a printing apparatus 2 is the difference in characteristic between conveyance rollers 70. In an arrangement in which a plurality of conveyance rollers 70 are arranged in the axial direction, the periodic component sometimes differs between the conveyance rollers 70. Thus, the peripheral region of the conveyance roller 70 having the smallest amplitude of the periodic component is selected. In this arrangement, fluctuation information is prepared for each conveyance roller 70.

If a region which satisfies these two conditions exists on a printing medium, this region is selected. If a region which satisfies these two conditions does not exist, the central region of the printing medium is preferentially selected. This is because correction control for the meander and skewed conveyance of a printing medium is not always easy, but fluctuation information of each conveyance roller 70 is already known. Note that the above-mentioned fluctuation characteristic is derived by using even fluctuation information of the conveyance roller 70 used to convey a printing medium.

Conveyance (backfeed) in a direction opposite to the discharge direction (forward feed) will be described. By forward rotation and backward rotation of a conveyance roller 70, a printing medium can be conveyed in forward and backward directions. Depending on the printing medium conveyance direction, the fluctuation amount of the conveyance amount sometimes changes. Of the periodic and constant components, the periodic component does not change. However, the constant component may change. This is influenced by the degree of back tension of the printing medium or the like.

A case in which backfeed is executed will be exemplified. The first example is pattern reading. That is, in a test print, the conveyance direction is switched between printing of an image and reading of the printed image. For example, an adjustment pattern is printed, and backfeed is performed at the timing of detection. The backfeed can be performed especially when ink is dried to stabilize the color and then the printed image is read.

All adjustment patterns to be detected are printed, and each pattern is moved to a drying position and dried. The printing and drying are repeated. After that, backfeed is executed, and the printing medium is moved to a reading position. The number of reading patterns to be printed increases depending on the number of adjustment patterns, increasing the backfeed amount. As a result, the deviation amount of the conveyance amount generated upon backfeed also increases. For this reason, a constant component (fluctuation characteristic) for backfeed needs to be derived.

The second example is printing using backfeed. To change the ink droplet landing position in multi-pass printing, backfeed by a small amount is performed after printing by forward feed, and printing is executed. Subsequently, forward printing, and backfeed by a small amount and printing are executed. Executing this printing can improve the image quality at the joint between passes, compared to forward feed printing. Since even the small-amount backfeed operation is a print operation requiring landing accuracy, the conveyance amount in backfeed requires the same conveyance accuracy as that in forward feed. Therefore, a constant component (fluctuation characteristic) for backfeed needs to be derived.

The third example is a set operation for a printing medium. Particularly, a large format printer executes the set operation to cope with printing media of a plurality of sizes. The set operation includes, for example, a width detection operation, and a skewed conveyance cancellation operation for improving setting of a printing medium. In the set operation, forward feed and backfeed are executed. If the conveyance amount in backfeed is not appropriate, it affects the accuracy of a margin at the leading end of a printing medium in printing. To prevent this, a constant component (fluctuation characteristic) for backfeed needs to be derived.

Figure 10B:
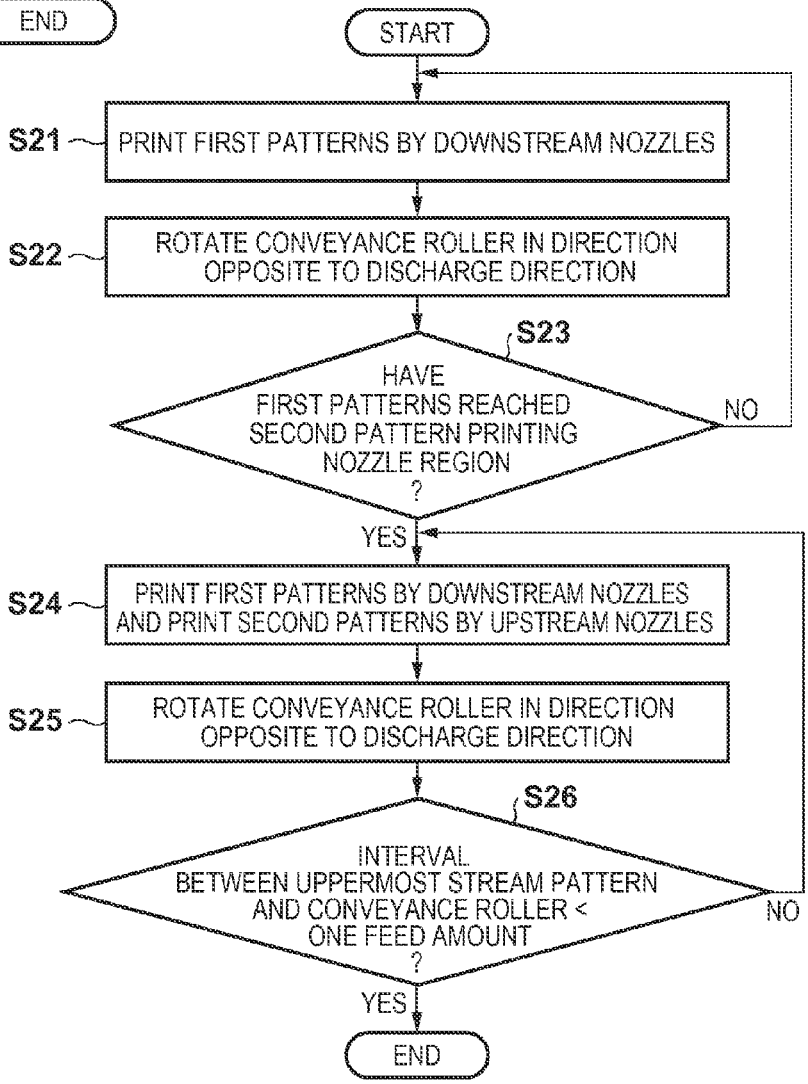
FIG. 10B is a flowchart showing a test print.
Figures 11A, 11B, 11C:
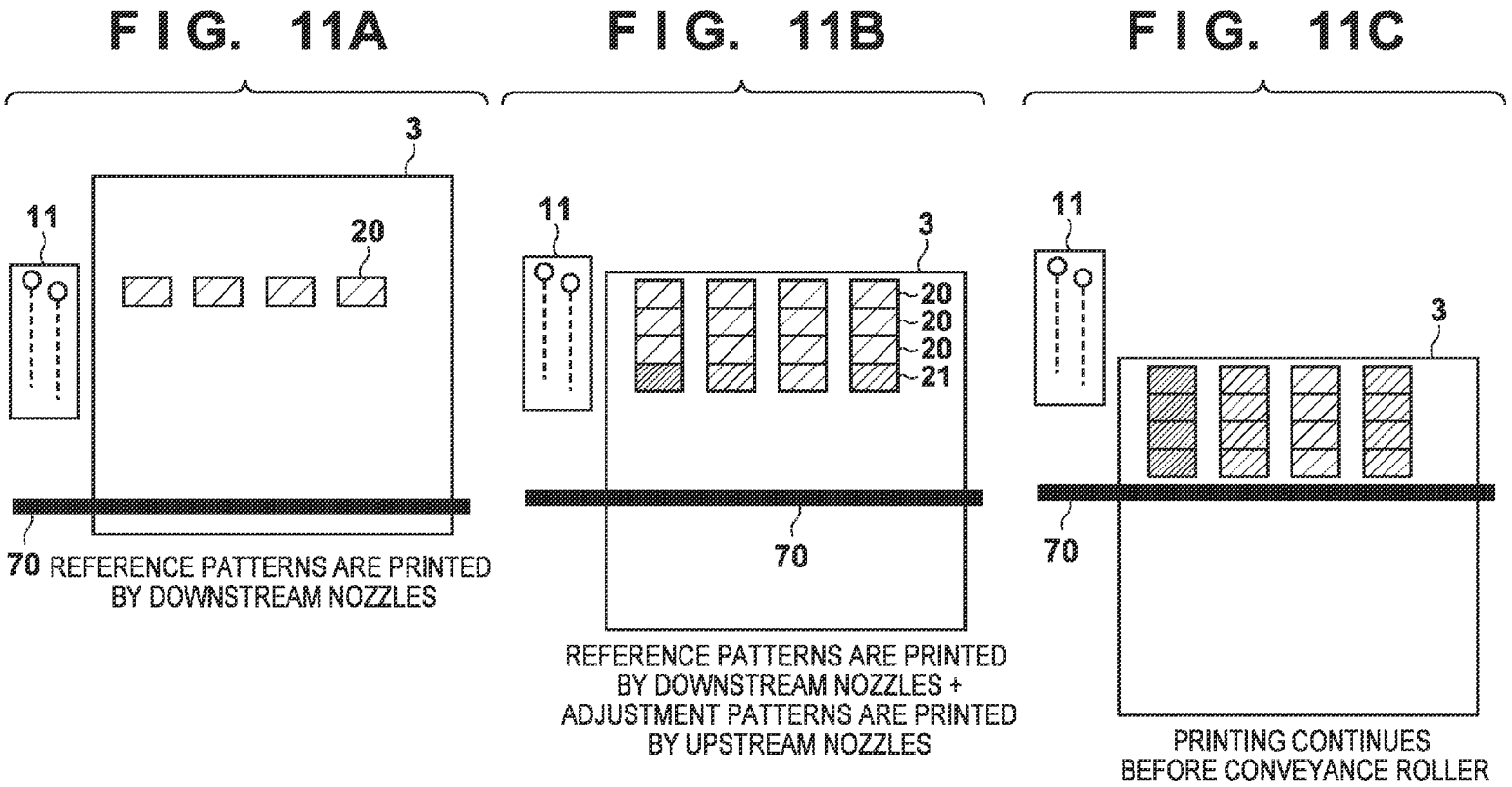
FIGS. 11A to 11C are views for explaining a test print.

FIG. 10B is a flowchart showing processing by a CPU 401 to perform a test print in order to derive a constant component (fluctuation characteristic) for backfeed. FIGS. 11A to 11C are views for explaining a test print. A test print in backfeed and a test print in forward feed are basically the same.

In step S21, reference patterns 20 are printed on a printing medium 3 by the downstream nozzles (block BL1 described above) of a printhead 11 (FIG. 11A). In backfeed, the reference patterns 20 are formed by the downstream nozzles in this way. Note that the printing positions of the reference patterns 20 are arbitrary as long as they are downstream of adjustment patterns 21. Not the reference patterns 20 but the adjustment patterns 21 may be printed by the downstream nozzles, and the reference patterns 20 may be printed by the upstream nozzles.

In step S22, the conveyance roller 70 rotates in a direction opposite to the discharge direction to feed back the printing medium. The backfeed amount is the conveyance amount of one unit used to derive a fluctuation characteristic.

In step S23, it is determined whether the reference patterns 20 have reached a nozzle region where the adjustment patterns 21 are to be printed. If YES in step S23, the process advances to step S24; if NO, it returns to step S21. In this case, a plurality of patterns are formed to derive a more accurate fluctuation characteristic.

In step S24, the reference patterns 20 are printed by the downstream nozzles, and the adjustment patterns 21 are printed by the upstream nozzles (FIG. 11B). If the reference patterns 20 have reached as a result of backfeed the nozzle region where the adjustment patterns 21 are to be printed, the adjustment patterns 21 are printed by the upstream nozzles to overlap the reference patterns 20. At this time, the reference patterns 20 may be simultaneously formed by the downstream nozzles.

In step S25, the conveyance roller 70 rotates in a direction opposite to the discharge direction to further feed back the printing medium 3. In step S26, it is determined whether the interval between the uppermost stream pattern and the conveyance roller 70 is smaller than the amount of one conveyance. If YES in step S26, the process ends; if NO, it returns to step S24. In this manner, overlapping printing of the reference patterns 20 and adjustment patterns 21 continues until the printed patterns reach the conveyance roller 70 not to step on a pattern by the conveyance roller 70 (FIG. 11C). Thereafter, the printed patterns are read to calculate an actual conveyance amount and specify a fluctuation characteristic.

The above embodiments have described an example of applying the present invention to an inkjet printing apparatus. However, the present invention is also applicable to another type of printing apparatus. The above embodiments have targeted a printing apparatus. However, the application field of the present invention is not limited to this, and the present invention is applicable to various control apparatuses which control a sheet conveyance mechanism by rotation of a roller.

The above embodiments have described an arrangement in which the printing apparatus 2 includes the sensor unit 30 for reading an image printed by a test print. However, the printing apparatus 2 may not include a sensor for reading the image. In this case, an image printed by the test print is read by a reading apparatus separate from the printing apparatus 2, an actual conveyance fluctuation amount is calculated, and the calculation result is input to the printing apparatus 2.

In the above embodiments, the actual conveyance fluctuation amount is detected based on a test print. However, the detection method is arbitrary as long as the actual conveyance fluctuation amount is detected by test conveyance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2012-101675, filed Apr. 26, 2012, which is hereby incorporated by reference herein in its entirety.

What is claimed is:

1. A printing apparatus comprising:

a printing unit configured to print an image on a printing medium;

a conveyance roller configured to convey the printing medium;

a storage unit configured to store first information about a conveyance fluctuation amount of sheet conveyance by the conveyance roller that depends on a rotational phase of the conveyance roller, and second information about a conveyance deviation amount of sheet conveyance by the conveyance roller that is independent of the rotational phase of the conveyance roller;

a calculating unit configured to calculate the second information based on an actual conveyance fluctuation amount acquired by reading test patterns printed by the printing unit and the first information stored in the storage unit; and a control unit configured to control a rotation of the conveyance roller when the printing unit prints an image according to the first information and the second information.

2. The apparatus according to claim 1, further comprising:

a reading unit is configured to read the test patterns; and a carriage configured to mount the printing unit and the reading unit.

3. The apparatus according to claim 1, wherein in a test print to print the test patterns, the printing unit prints a first pattern on the printing medium, the conveyance roller conveys the printing medium by a predetermined conveyance amount, and then the printing unit prints a second pattern on the printing medium, and the first pattern and the second pattern are printed to change a form of overlapping between the first pattern and the second pattern in accordance with an actual conveyance amount of the printing medium.

4. The apparatus according to claim 3, wherein the first information includes information representing a conveyance fluctuation amount corresponding to a rotational phase of the conveyance roller, and the calculating unit is configured to calculate an estimated conveyance fluctuation amount based on, of the first information, the information corresponding to a rotational range from a rotational phase of the conveyance roller when the first pattern is printed, to a rotational phase of the conveyance roller when the second pattern is printed.

5. The apparatus according to claim 1, wherein the control unit selects, in accordance with a size of the printing medium, a region on the printing medium where the test patterns are to be printed.

6. The apparatus according to claim 1, wherein the conveyance roller can convey the printing medium in a forward direction and a backward direction by forward rotation and backward rotation of the conveyance roller, the test patterns are printed a case in which the printing medium is conveyed in the forward direction and a case in which the printing medium is conveyed in the backward direction, and the second information is determined in the case in which the printing medium is conveyed in the forward direction and the case in which the printing medium is conveyed in the backward direction.

7. The apparatus according to claim 1, wherein the second information is determined to be stored in the storage unit in a manufacturing process of the apparatus or in a user's environment.

8. A control apparatus comprising:

a conveyance roller configured to convey a sheet;

a storage unit configured to store first information about a conveyance fluctuation amount of sheet conveyance by the conveyance roller that depends on a rotational phase of the conveyance roller, and second information about a conveyance deviation amount of sheet conveyance by the conveyance roller that is independent of the rotational phase of the conveyance roller;

a calculating unit configured to calculate the second information based on an actual conveyance fluctuation amount acquired by reading test patterns on a test sheet and the first information stored in the storage unit; and a control unit configured to control a rotation of the conveyance roller according to the first information and the second information.

9. A method for determining correction data for rotational control of a conveyance roller, comprising:

acquiring first information about a conveyance fluctuation amount of sheet conveyance by the conveyance roller that depends on a rotational phase of the conveyance roller;

detecting an actual conveyance fluctuation amount when test conveyance of a test sheet is performed; and calculating second information about the conveyance deviation amount of sheet conveyance by the conveyance roller that is independent of the rotational phase of the conveyance roller, wherein the second information is calculated based on the detected actual conveyance fluctuation amount and the first information.

10. The method according to claim 9, wherein the rotation of the conveyance roller for conveying a sheet is corrected by using at least the second information.

* * * * *